United States Patent [19]

Bevilacqua

[11] Patent Number: 4,612,742

[45] Date of Patent: Sep. 23, 1986

[54] WALL AND FOUNDATION DRAINAGE CONSTRUCTION

[76] Inventor: Joseph Bevilacqua, 903 Bevan St., Akron, Ohio 44319

[21] Appl. No.: 535,157

[22] Filed: Sep. 23, 1983

Related U.S. Application Data

[63] Continuation of Ser. No. 245,269, Mar. 19, 1981, abandoned.

[51] Int. Cl.[4] ..... E04B 1/64

[52] U.S. Cl. ..... 52/169.5; 52/302

[58] Field of Search ..... 52/169.5, 169.14, 198, 52/302, 303

[56] References Cited

U.S. PATENT DOCUMENTS

| | | | |
|---|---|---|---|
| 3,283,460 | 11/1966 | Patrick | 52/169.5 |
| 3,287,866 | 11/1966 | Bevilacqua | 52/169.5 |
| 3,562,982 | 2/1971 | Parezo | 52/303 |
| 4,253,285 | 3/1981 | Enright | 52/169.5 |

OTHER PUBLICATIONS

American Builder, May of 1959, pp. 212 and 213.

*Primary Examiner*—James L. Ridgill, Jr.

*Attorney, Agent, or Firm*—Oldham, Oldham & Weber Co.

[57] ABSTRACT

The foundation wall and drainage system includes a conventional footer, a hollow building block wall positioned on the footer, a drain tile adjacent the footer, an impervious plastic sheet secured to the inner surfaces of the wall, which wall has openings in the lower course thereof connecting the center of the blocks to the interior of the basement at the top surface of the footer, a drain device member having a plurality of drain slots, openings or recesses formed in the lower surface and having a covered top positioned on a top portion of the footer and extending from the foundation wall to a point beyond the footer and extending from the foundation wall to a point beyond the footer for drainage of water from the wall to a point above the drain tile, gravel fill around the drain and drain device, and a cement floor positioned on the gravel fill.

3 Claims, 3 Drawing Figures

WALL AND FOUNDATION DRAINAGE CONSTRUCTION

CROSS-REFERENCE

This is a continuation application of application Ser. No. 245,269 filed Mar. 19, 1981 now abandoned.

TECHNICAL FIELD

The present invention relates to building constructions and particularly waterproof assemblies for providing foundation walls for basements having built in drainage means therein to prevent water and dampness accumulating in the building basement, and includes a footer, a drain tile positioned adjacent the inner margin of the footer, a wall formed of conventional hollow building blocks on the footer, a plastic sheet secured to inner surfaces of the wall, the lowermost course of building blocks having portions on the inner surfaces thereof communicating with the interiors of the blocks to form drainage openings adjacent the drain tile, a drain device comprising a member having a plurality of drain slots formed in its lower surface and having a continuous top positioned on an upper portion of the footer and extending therebeyond for flow passages of water or moisture from the lower end of the building block wall to the drain tile, gravel fill extending over the drain device and drain tile, and a cement floor on the gravel fill, the drain device being abutted at one end against the blocks to connect the drain slots thereto, and the drain device extending the length of the footer and foundation wall.

BACKGROUND ART

The present invention relates to the same type of foundation and wall drainage systems as is well shown and covered in my previous U.S. Pat. No. 3,287,866. While such system works well, there are always improvements that can be made in the drainage of foundations and walls as basements in many buildings are subjected to a variety of conditions that force water into the foundation wall and that produce a seepage of water into the basement of the home or building.

In my prior construction, drainage openings were formed in the inside of the lowermost course of blocks forming the foundation wall and water flowing from such drainage openings then could flow down through the gravel filling material to a drainage tile provided adjacent the internal edge of the footer supporting the foundation wall. While this system has worked well, the material used for filling around the footer, foundation wall and drainage openings may become tightly packed and sand and gravel may pack into such construction and tend to slow down or prevent good drainage through the system.

There have also been other systems to provide the good drainage for foundations and U.S. Pat. No. 3,852,925, for example, provides a sheet of plastic placed over a portion of the gravel provided in the foundation to aid in controlling water seepage and flow, and U.S. Pat. No. 3,332,185 is of interest as it provides a plastic duct formed at the corner between the foundation wall and the basement floor to aid in drainage action. U.S. Pat. No. 3,562,982 was another approach to wall drainage and it comprises providing a special drainage tube connected to the interior of the hollow blocks of a foundation wall to drain water to a point external of the building foundation.

A subterranean wall drain unit is shown in U.S. Pat. No. 3,654,765 that utilizes an impervious plastic sheet formed into a drain unit with water previous sheet material to be affixed to the outer wall of a foundation to aid in preventing water entrance into the foundation wall. Yet other patents of general interest in the drainage field for foundations include U.S. Pat. No. 3,304,672 which relieves external hydrostatic pressure from the foundation and U.S. Pat. No. 3,754,362 that has a filamentry filter layer in the foundation construction for drainage and seepage control purposes.

DISCLOSURE OF THE INVENTION

The general object of the present invention is to provide a novel, improved wall and foundation drainage system or construction that is particularly resistant to being clogged by gravel, slag, silt or sand surrounding the drainage system in the building foundation.

Another object of the invention is to provide a more or less bridged, small drainage unit in flow communication with the foundation wall and permitting seepage of water to an associated drain pipe position internally of the foundation and below the floor of the building.

Yet other objects of the invention are to provide an improved wall and foundation drainage apparatus which is relatively inexpensive to build but which is sturdy in construction; to provide an efficiently functioning drainage unit that will provide a long service life in building foundations; to provide a drainage system that is easy to install during construction of a building; and to use a plastic or other durable material forming a bridged multichannel water seepage conductive unit in a building foundation in direct communication with the foundation wall and any water accumulating therein.

The foregoing and other objects and advantages of the invention will be made more apparent as the specification proceeds.

BRIEF DESCRIPTION OF THE DRAWINGS

Reference now is particularly directed to the accompanying drawings, wherein.

Referring to corresponding numbers shown in the specification and referred to in the drawings, corresponding numerals are used to facilitate comparison therebetween.

BEST MODE FOR CARRYING OUT THE INVENTION

Figure 1:
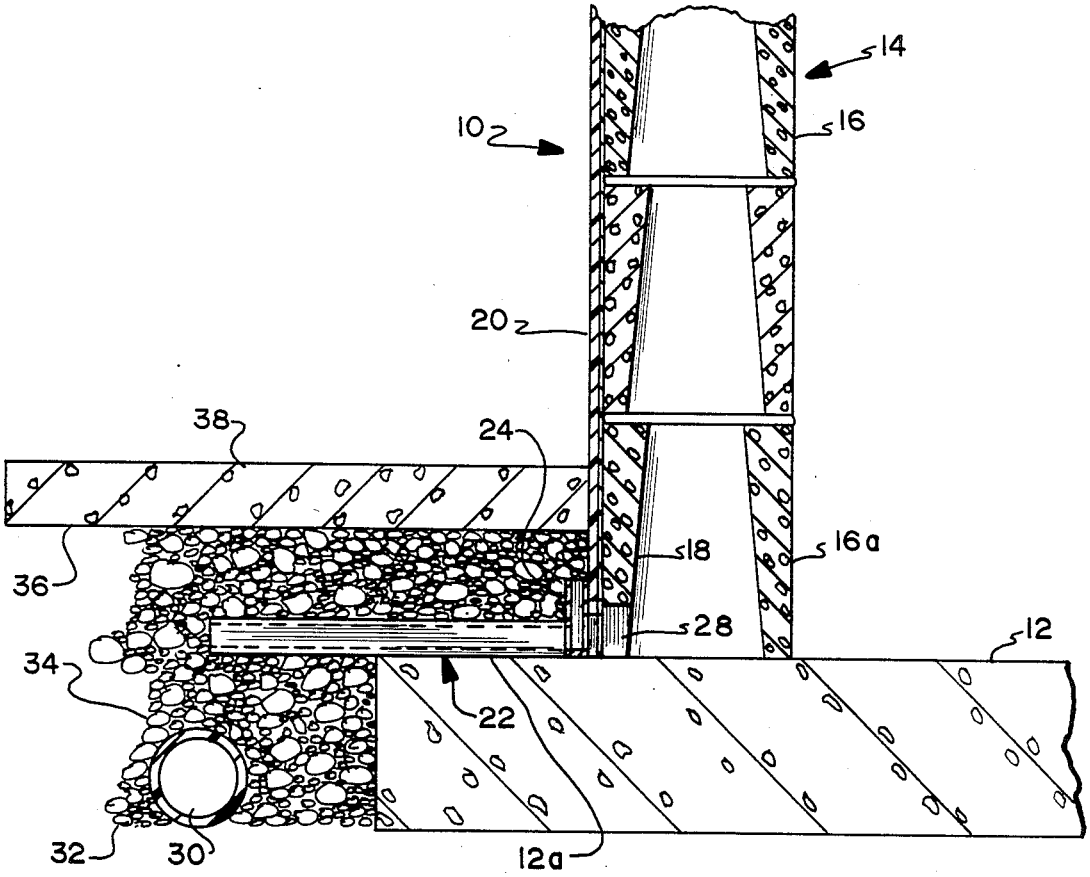
FIG. 1 is an enlarged fragmentary vertical section of a portion of a building foundation, floor and wall unit embodying the principles of the present invention.
Figure 2:
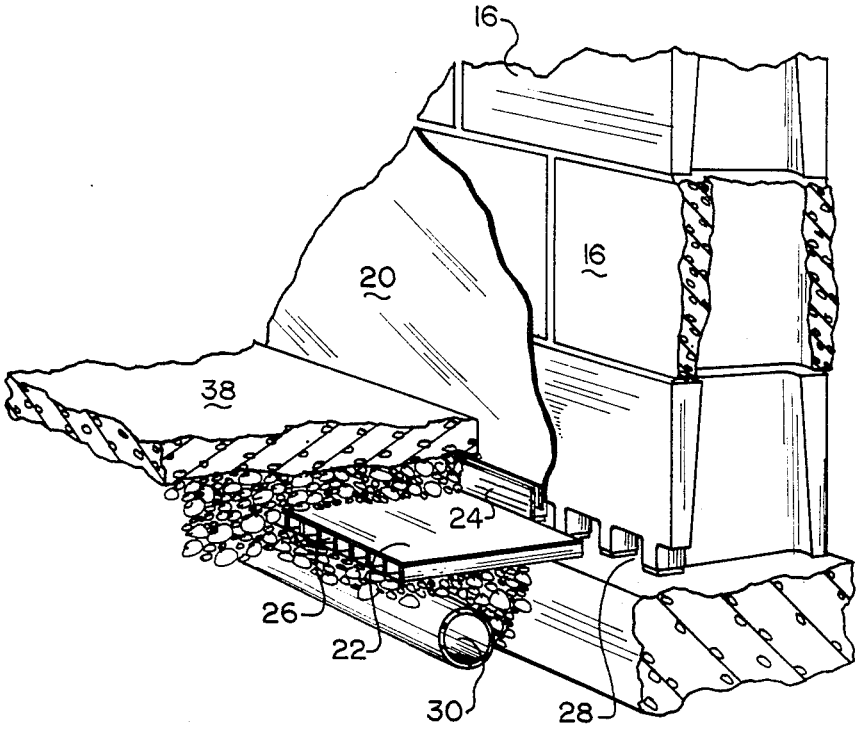
FIG. 2 is a broken away perspective view, partially in vertical section of the construction of FIG. 1.
Figure 3:
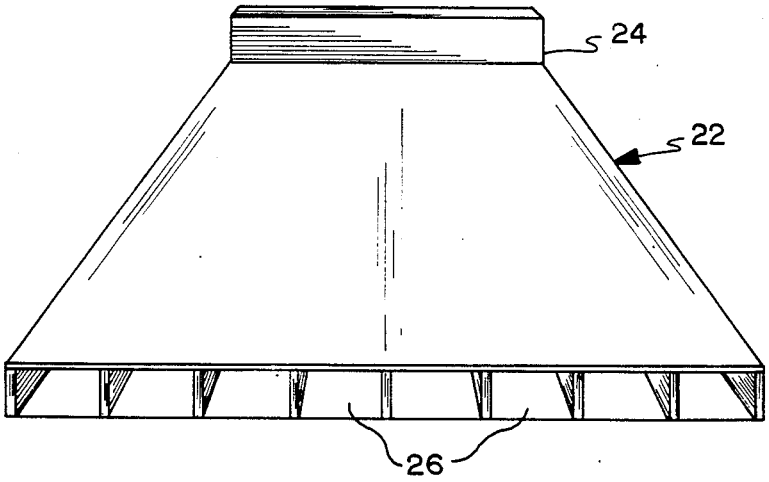
FIG. 3 is a perspective view of the covered drain member of the apparatus of the invention.

Attention now is particulary directed to the details of the structure shown in the drawings, and the new improved wall and foundation construction of the invention is indicated as a whole by the numeral 10. This unit is a portion of a conventional building for either residential or industrial use and the unit includes a footer 12 and a concrete block wall 14 formed from a plurality of hollow building blocks 16 that are assembled in conventional relationship with each other to provide the wall enclosing a basement area for the building. These blocks 16 have center openings 18, normally extending from top to bottom thereof and the blocks are aligned with each other vertically whereby any water seeping into the center area of these blocks from the associated dirt outside the foundation will flow downwardly through the wall and collect on the upper surfaces of the footer 12.

As one portion of the invention, if desired, some type of an impervious thermoplastic plastic sheet 20 is suitably adhesively secured to the inner surface of the blocks forming this wall 14 and it will prevent water from seeping through the wall into the building basement. This plastic sheet normally extends substantially the height of the wall as embedded in the ground but terminates a short distance, such as half an inch to one or two inches above the top surface of the footer 12.

As an important element of the present invention, a novel drain device 22 is positioned on the top surface of the footer 12 and on the inner surface of the wall 14. The drain device can be made from any suitable material but preferably is made from a very tough, sturdy plastic material such as fiber reinforced polystyrene, nylon or any other suitable reinforced plastic material that has good operative strength and is weather resistant. The drainage device includes an end flange 24 that may, for example, be suitably secured to the lower end of the plastic sheet 20. However, the drain device as an important feature thereof includes a plurality of drain slots, openings or recesses 26 on its lower surface. This drain device 22 naturally is positioned upon the footer 12 and is of such length that it normally protrudes beyond the inner end of the footer 12 as indicated in the drawings. Thus, by the plurality of protected drain slots 26 in the under surface of this drain device, any water accumulating at the lower end of the wall 14 and/or on the top surface of the footer, would flow through the lowermost blocks 16*a* in the wall and particularly these blocks 16*a* can have longitudinally spaced communicating openings 28 formed in space portions thereof so that water seeping into the wall from the ground can gradually seep or flow from the wall through the openings 28 and drain out through the drain slots 26.

The building also has provided therein a suitable drain tile 30 that is positioned to extend along the inner margin of the footer 12 and this drain tile 30 usually is positioned on a thin layer of small slag indicated at 32. After the drain tile is in position, and the drain device 22 has been positioned, then some larger slag material 34 of any conventional type can be carefully poured into and around the drain tile to cover it and ultimately to cover and position the drain device 22 in good permanent contact with the footer 12. Obviously, the drain device 22 preferably will extend the entire length of the footer to permit ready drainage of water seeping into the foundation wall 14.

In order to complete the basement, normally some additional layer of small slag 36 would be applied over the slag layer 34 and then the building floor 38 itself would be poured over the entire assembly.

Usually this inner edge of shoulder on the footer 12 indicated at 12*a* is only about four inches wide and then the drain device itself would be, for example, about six inches wide and would protrude beyond the edge of the footer as shown in the drawings. The slots 26 extend from the wall 14 to and beyond the inner edge of the footer. Of course the drain device 22 can be made in sections and can extend the length of the footers.

By the construction of the invention, I have been able to prevent undesired water seepage through the wall 14 of the foUndation, and now have also provided for a controlled, guided path of exit flow for water accumulating at the lower portion of the walls 14.

My new apparatus is sturdy and will be moisture and weatherproof as many plastic materials will provide excellent service life even positioned in contact with the ground or slag as is the drain device of the invention in my new construction.

The unit is easy to assemble and position and will provide effective drainage action to control seepage of water that would otherwise enter into the foundation and thus damage the basement or accumulate on the walls or floor of the foundation so that the water will be lead safely to the drain tile 30. Obviously, such drain tile can connect to any other conventional drain means at external portions of the building foundation. Thus, it is believed that the objects of the invention have been achieved.

While one complete embodiment of the invention has been disclosed herein, it will be appreciated that modification of this particular embodiment of the invention may be resorted to without departing from the scope of the invention.

What is claimed is:

1. A foundation wall construction comprising a footer, a drain tile extending along adjacent one margin of said footer, a wall on said footer and formed of hollow building blocks having openings in their upper and lower surfaces arranged vertically on said footer, the lowermost row of said building blocks having enlarged openings in the inner surfaces thereof that connect with the interiors of said hollow building blocks and form drainage openings adjacent and above said drain tile, said foundation wall forming part of a basement and said wall having inner and outer surfaces, a drain device comprising a covered member having a plurality of longitudinally enclosed drain slots formed in its lower surface positioned on a top portion of said footer and extending therebeyond substantially to said drain tile, said drain device having an end abutted against said inner surface of said blocks whereby the drain slots are in liquid flow communicable with the enlarged openings in the building blocks, said drain slots extending substantially perpendicular to the building blocks and the length of said drain device, a gravel fill over said drain tile and drain device and extending to said blocks, and a cement floor pad on said gravel fill.

2. A foundation wall construction as in claim 1, and including a plastic sheet secured to the inner surfaces of said wal and terminating immediately above the upper surface of said footer.

3. A foundation wall construction as in claims 1 or 2, where different size gravel or slag are present in different areas of said gravel fill.

* * * * *